United States Patent [19]

Thomas

[11] Patent Number: 4,539,896

[45] Date of Patent: Sep. 10, 1985

[54] AIR HEATING AND FILTERING APPARATUS

[76] Inventor: Alfonso Thomas, 894 N. James St., Hazleton, Pa. 18201

[21] Appl. No.: 541,779

[22] Filed: Oct. 13, 1983

[51] Int. Cl.[3] ..... F24F 9/00; F24H 3/00

[52] U.S. Cl. ..... 98/1; 98/36; 98/33.1; 219/360; 55/DIG. 29

[58] Field of Search ..... 98/40 C, 40 R, 40 D, 98/36, 33 R, 1; 237/46, 50; 55/DIG. 29, 482; 219/360

[56] References Cited

U.S. PATENT DOCUMENTS

| | | | |
|---|---|---|---|
| 2,896,061 | 7/1959 | McMillan | 219/360 X |
| 3,474,720 | 10/1969 | Qualley et al. | 98/33 R |
| 3,659,515 | 5/1972 | Galaniuk | 98/40 C X |

*Primary Examiner*—Henry Bennett

*Attorney, Agent, or Firm*—Anthony J. Dixon

[57] ABSTRACT

A heat zoning apparatus which comprises air filtering and smoke detecting as well as heat zoning control primarily for residential applications wherein more than a one story building is occupied with a single zone heating system. Embodiments for various mounting and configurations are disclosed as well as smoke detection and inhabitant warning and life saving devices.

1 Claim, 7 Drawing Figures

AIR HEATING AND FILTERING APPARATUS

BACKGROUND OF THE INVENTION

1. Field of the Invention

The present invention relates to a heat zoning apparatus adapted to be mounted in stairwells and the like.

More particularly, the present invention relates to a residential forced air heat zoning apparatus which circulates air in one area of a living space and minimizes the loss of heat from lower levels to upper levels through staircase openings.

Further, the present invention relates to a residential heat zoning apparatus which can be adapted to air filtering applications and smoke detection applications while performing its primary zoning function.

2. The Prior Art

Heretofore, air flow systems have been utilized for various functions or purposes. For example D. F. Denny in U.S. Pat. No. 3,462,920 discloses a gaseous bed curtain apparatus for use in hospitals and the like, a limited and highly specialized application of the technology in general. C. Caille in U.S. Pat. No. 2,939,374 issued June 7, 1960 discloses a doorway screening device which has a novel, expandible duct feature; however, the Caille device is limited in that it merely separates two areas and does not provide filtering or heat zoning. Further the device is particularly limited to high velocity screening applications which would be less than comfortable in residential applications. Also, no directional means other than true vertical flow is provided.

A further air screen apparatus can be seen in U.S. Pat. No. 3,145,641 issued to J. M. Morrison on Aug. 25, 1964. This reference discloses a particular door screening application which provides intake at door-top level and out flow directed vertically over the door opening. Adjustment vanes are provided; however, they do not deflect air into the protected space but rather spread it horizontally to accommodate a door wider than the unit. Such a device does not contemplate filtering or smoke detection.

The above references look to the known and predominant uses of air screening technology normally used in industrial or commercial uses with high pressure air flows and doorway or barrier applications. The art in general does not accommodate the layman user who needs a system which is inexpensive and easy to install, that is a system designed primarily for residential use.

Further, a need exists for adaptation of existing heating means in homes without major modifications of existing plumbing or duct work so as to lessen the energy cost for those living in the many multistory buildings now in general residential use especially the 25–50 year old two-story semidetached and row type homes so common to the country, city and suburban neighborhoods.

Further, a need exists for a decorative unit which can operate on normal house current so as to be readily usable by residential dwellers.

Further a need exists for an appartus which is readily convertible and adaptable to varying architectural styles and which provides a zoning function without uncomfortable drafts which occur from known air curtains.

Further, a need exists for an apparatus which combines energy saving features with smoke detection and fire warning features and air filtering features which is readily and easily installed by the layman.

SUMMARY OF THE INVENTION

These and other needs existing in the art are met by the present invention which provides a heat zoning, smoke detection and air filtering device designed primarily for residential applications especially in two story or multistory dwellings.

It is an object of the present invention to provide a residential heat zoning system which separates two levels of a structure by halting the natural upward flow of heated air by use of a fan and ductwork.

It is a further object of the present invention to provide an energy saving apparatus generally useful in two story or multistory structures with open stairways.

It is a further object of the present invention to provide an improved home air filtering device.

It is a further object of the invention to provide an improved smoke detection and fire warning system.

It is a further object of the present invention to provide an apparatus which can meet all of the above needs while being readily convertible and adjustable so as to be inexpensively adaptable to various architectural configurations.

These and other objects are met by the present heat zoning and smoke protection and air filtering apparatus which generally comprises:

a. a generally rectangular main body or housing which comprises an intake section, a blower section, a filtering means and a blower outlet,
b. a blower or fan mounted in the housing communicating with the intake means and the blower outlet,
c. means for filtering the air flowing into the housing,
d. a smoke detection device mounted on the bottom of the fan section,
e. a generally cylindrical outlet duct communicating between the blower outlet and the area to be treated,
f. means for rotating said outlet duct, a multiplicity of outlet ports defined in the walls of the outlet duct,
g. means for supplying power to the fan or blower and smoke detector, and
h. means for mounting the entire apparatus on a wall at ceiling height whereby air is pulled through the intake means and the filtering means by operation of the fan and blown out through the blower outlet and along the outlet duct resulting in an air discharge at the duct height causing air to flow through the outlet ports in a downward direction resulting in an air barrier along the duct length.

In one embodiment the unit is wall mounted so that air is discharged along the length of an outlet duct which transverses a stairwell opening at the ceiling height of the room at the lower level of the stairway. Heated air rising naturally in the room is taken into the apparatus and discharged along the length of the outlet duct causing a barrier to be formed across the stairwell opening.

The outlet duct is rotationally attached to the outlet section of the housing so that the direction of air flow along its length can be varied from near vertical to almost about horizontal to achieve desired results in given applications.

Further, duct elbows can be provided if two directional application is required. Section of duct to increase length are slidingly connected one to the other.

Primary and secondary filtering can be provided.

These and further details will be more readily apparent upon review of the drawings and the description of the preferred embodiment which follows.

THE PREFERRED EMBODIMENT

Figure 1:
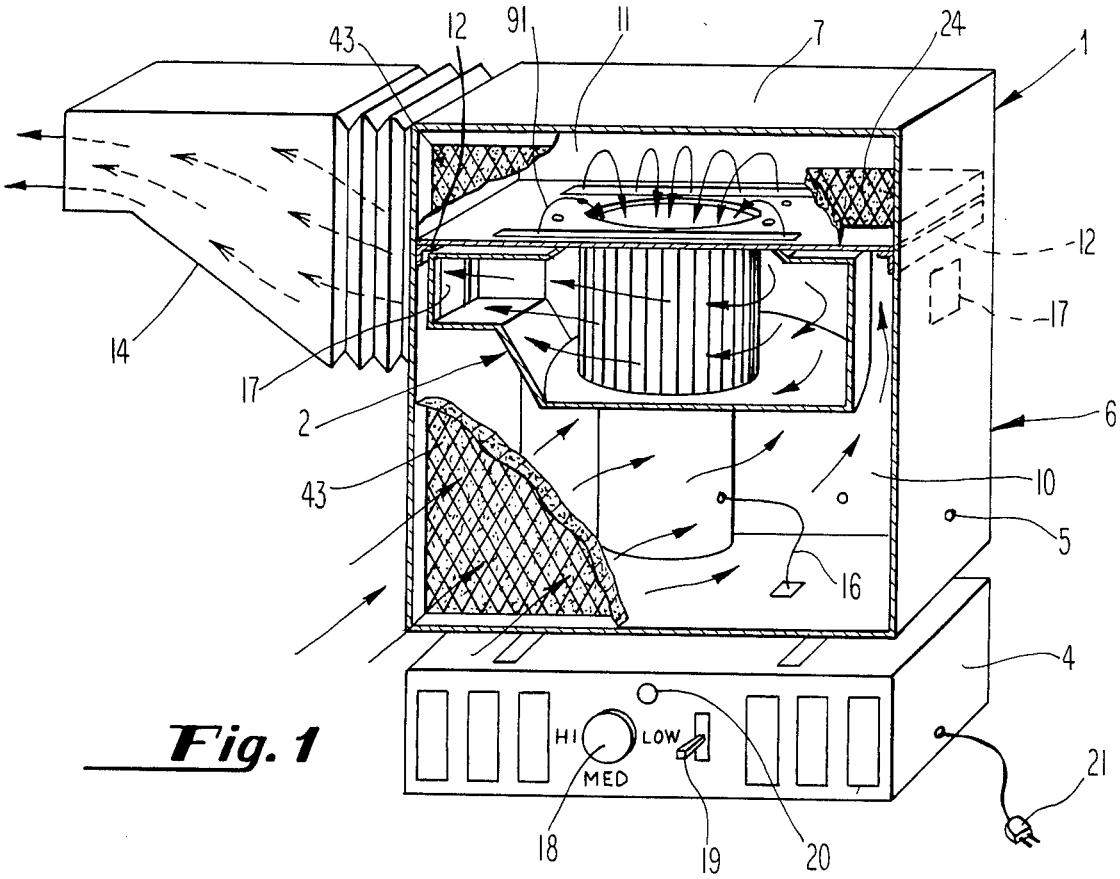
FIG. 1 is a frontal perspective view of the central housing.
Figure 6:
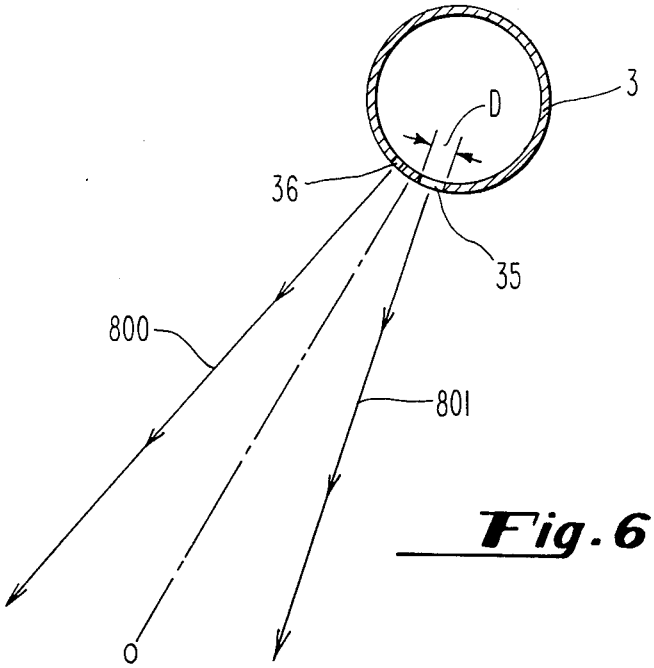
FIG. 6 is a cross-sectional view of the cylindrical duct showing the outlet air flow.
Figure 7:
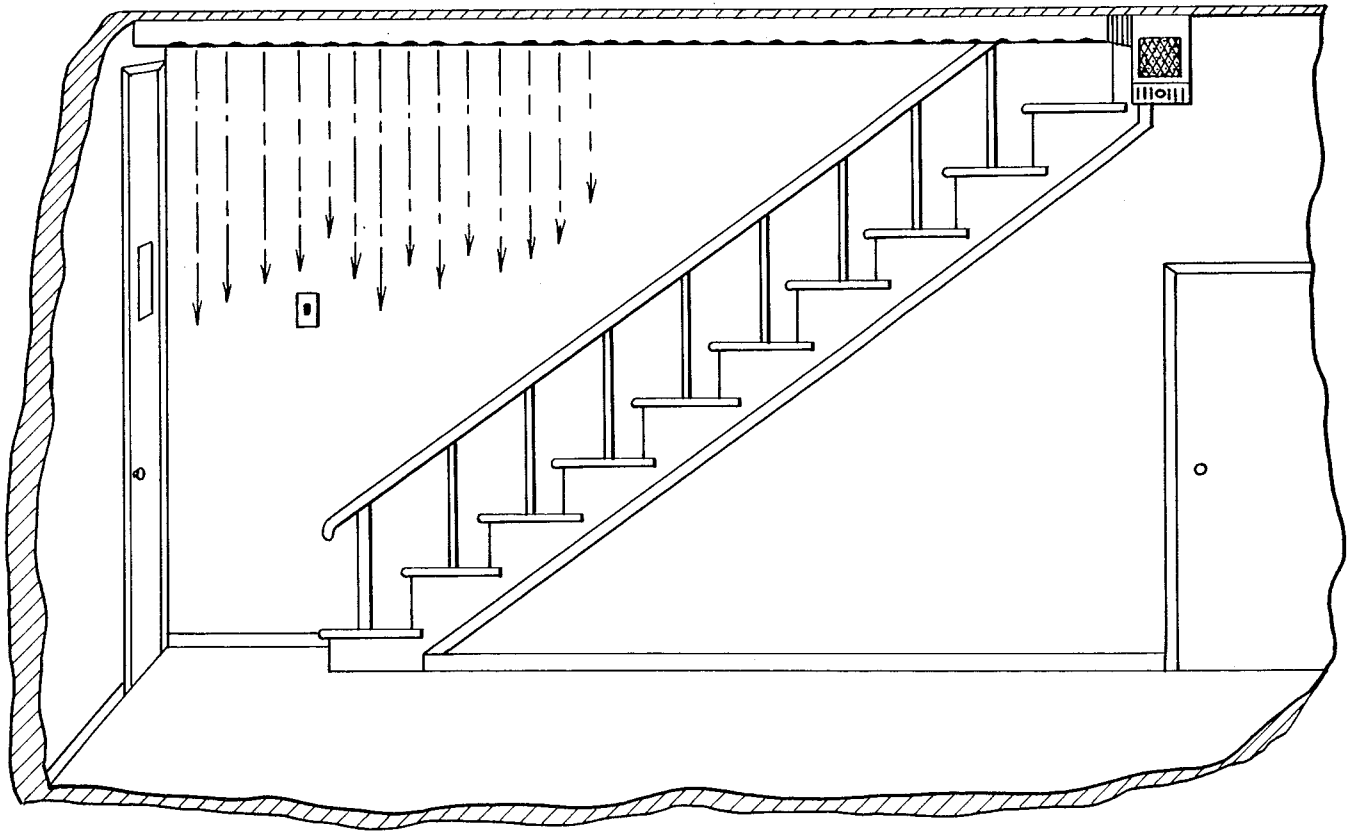
FIG. 7 is a perspective view of the invention in use.

Referring initially to FIG. 1, the general configuration of the present apparatus can be seen. The main housing 1 is generally rectangular in configuration with the major elements, the lower section 4, the fan or blower section 10 and the final filtering section 11. The blower mounting and operation should be viewed with FIG. 2 also in mind. Air flows to the interior of housing 1 through the filter 43 which covers the entire front of blower section 10. Air is pulled upwards toward the blower inlet 15 through ports 23 defined in horizontal mounting plate 9. Air flows into chamber 11 in which final filtering can be provided. Air then flows into blower 2 and is blown through blower outlet which communicates with outlet adapter 14 through knockout port 17. A knockout port 17 is also provided on the opposite side to provide for right or left mounting. Air then flows into duct 3. Since the duct is generally cylindrical, an adapter 27 is provided to fit on the rectangular connector 14 on one side and the cylindrical duct on the other. The adapter has a second purpose in that its cylindrical outlet connection or collar 271 is accommodatingly larger than the outlet duct 3 so as to allow duct 3 to be rotated around the center line. See FIG. 3. The need for this rotation is to provide a variable outlet air flow through ports 35 and 36 which are along line 41 of duct 3. See FIG. 3. By rotating duct 3 the angle of the outlet air flow can be altered relative to a vertical plane. This is more fully shown in FIG. 6 where a figurative air flow is shown. Air escaping from duct 3 will naturally expand upon exiting so that it strikes the floor over an angle from about back line 800 to front line 801. The adjustment of the angle of the ports 35 and 36 relative to vertical allows the user to adjust the air flow as to how much deflects into the room.

Ideally, back line 801 is such that the air flow at that point is slightly inward to allow inward deflection. A back line position beyond vertical that is outward from the room will result in a less efficient operation since the reflected flow will be away from the area being screened.

Figure 5:
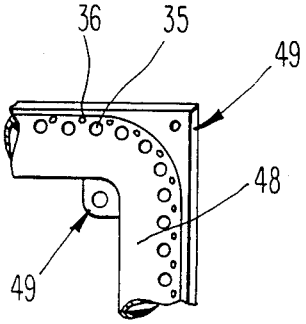
FIG. 5 is a perspective view of an elbow section.

The flexible configuration of outlet section 14 is to accommodate the user in duct work sizing for the length of duct 3. Further ductwork configurations are also provided such as elbow 48 which is prepunched with outlet ports 35 and 36 and means for mounting to a wall or ceiling, 49. See FIG. 5. Unfortunately, these port positions are not alterable by rotation as is true of the ports in straight duct sections. Ports 35 and 36 in all sections however, are preferably punched from the inside out to facilitate the flow of air. In order to accomplish this, the holes are punched before the duct material is rolled or shaped into its finished configuration. It is also anticipated that various lengths would be available for the user.

Positioning of the ports in a given application is usually by trial and error; however, to make repeat application and adjustment more convenient, a scale 28 is printed on adapter 27. The zero position is achieved by the ports facing a true vertical with increasing angle readings to the left and right so as to make the system usable regardless of the position of the stairway or opening in the dwelling or structure being zoned. At the duct terminus, an end cap is provided which is slidingly mounted on duct 3.

Figure 2:
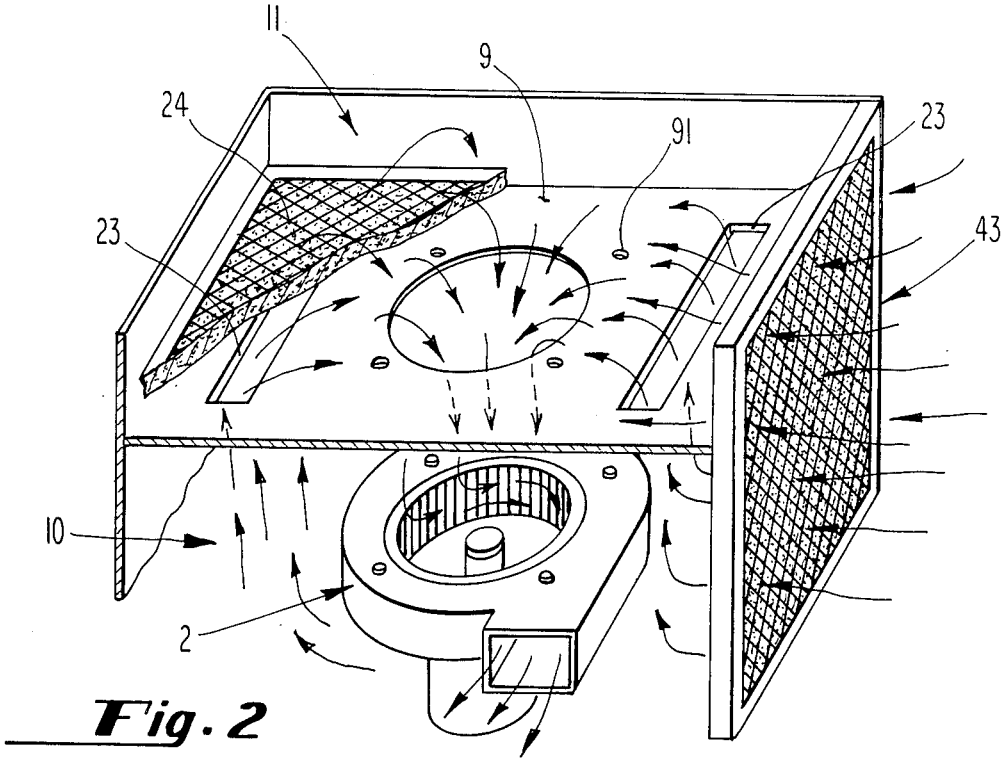
FIG. 2 is an exploded sectional view showing the blower mounting.
Figure 4:
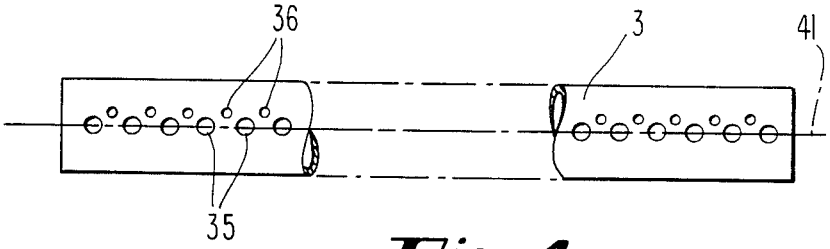
FIG. 4 is a perspective view of the outlet duct.
Figure 3:
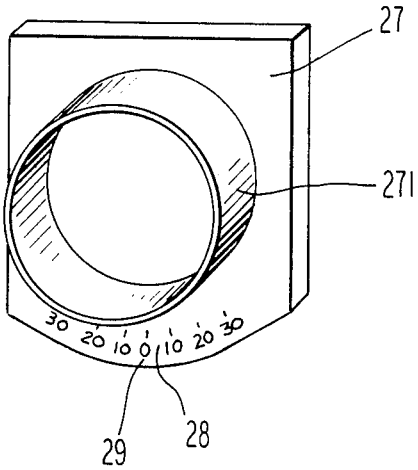
FIG. 3 is a perspective view of the coupling bracket.

The interior configuration of main housing 1 is best understood by referring to FIGS. 1 and 2.

FIG. 2 shows fan or blower 2 mounted in the fan section 10. The mounting is fixed; however, it is anticipated that the fan or blower can be removed for maintenance, repair and replacement if needed.

Since the blower is mounted to plate 9 by bolts 91 or the like, removal is easy and left-right adaption quite straight-forward, since the entire plate with blower attached slides out along mounting bars 12 and 13 as shown in FIG. 1. In operation, air is filtered by face plate filter 43 which covers the entire section 10; however, this air also flows via ports 23 to section 11. It is envisioned that a second filter or final fitler 24, not shown installed, can be horizontally mounted across plate 9 so that the air is filtered again prior to entry to blower. Air discharged through blower to flexible adapter 14 and finally to duct 3 via adapter 27 is thereby cleaned. These filter elements can be made from fiberglass, charcoal, dynel or the like.

Due to supplemental heating units such as wood, coal, kerosene etc. now in widespread home use, concentration of contaminants such as carbon monoxide, nitrogen dioxide, sulfer dioxide and the like, as well as other products of combustion can build to unacceptable levels. It is envisioned that final filter element 11 can eliminate some, if not all of these contaminants. Further, cooking odors and suspended contaminants such as grease, smoke and the like can be cleaned out of the air stream.

Further features of the device are shown in FIG. 1. Lower section 18 is used for the positioning of on-off switch 19, light 20 and variable speed controller 19. Power source AC is shown as standard plug 21. The DC power source for the smoke detector is the standard battery source commercially and readily available on the market place.

An AC power source is connected to fan or blower 2. A switch is in series in the circuit. A rheostat 18 is provided whereby the speed of motor on FIG. 2 can be adjusted in the normal fashion.

If cooking or heavy smoke is being done in the home, it is possible that a sensitive smoke detector unit will be caused to respond with its alarm. To avoid this problem, switch 19 can be opened until this cooking activity ceases. However, if this is done a beep or light flash will warn the user of the system being unarmed.

If is further envisioned that the unit can be activated by a positive smoke detector signal. If the unit is not being used it is envisioned that an AC-DC relay is provided in an open position. A positive smoke reading in the circuit causes the circuit relay to close to turn on the blower apparatus to allow time for residents to respond prior to incapacitation by smoke inhalation. In this embodiment, it is preferred that the variable speed controller is preset at its maximum position to maximize protection to inhabitants. The protection will initially be due to the high volume air curtain effect in keeping hot and contaminated air confined to one area, since filters will quickly become ineffective in such an enviroment. Yet, the extra filtering will add to inhabitants exit time.

When the unit is operating as designed, it is anticipated that the air flow leaving ports 35 and 36 will be turbulent and will expand to a flowage of about 20–25 degrees at a distance of about 20 diameters of the outlet port from the outlet. The air flow slows down as distance from the duct is increased; therefore, angle adjustment has to be made based on elevation of the unit above the floor. In a standard eight foot room, tests show the angle is about 35 degrees measured from vertical into the room to be treated and zoned.

In a particular sample home where the unit was tested, the normal first floor temperature was running at 68 to 70 degrees in the heating season with the second floor maintaining 70 to 72 degrees due to first to second level heat loss. After application of the present unit, the first floor could be maintained at 70 to 74 degrees while the second floor did not rise above 66 to 68 degrees. Further testing showed that during time periods of similar outside temperature, a given residence could achieve energy savings of up to 39% by use of the zoning method achieved by the present invention. In these tests a fixed heat source was used to gauge savings. This source was a kerosene heater. Further, heat stratification which is always a problem in multistory buildings is eliminated.

Although a particular configuration is disclosed herein, it is envisioned that minor modifications and adjustments can be made without departing from the scope of the present invention. For example, a decorative cover for the main housing is contemplated but its particular configuration would not be deemed essential or limited facet of the apparatus herein disclosed as a whole. Further, various filtering elements can be employed although disposable electrostatic filters are preferred. Further the unit can be floor mounted with a first duct being vertical to flow the air to the main horizontal duct and ports.

These and other modifications are within the scope of the present disclosure and appended claims.

I claim:

1. A heat zoning apparatus for residential buildings with more than one story which comprises a. a generally cube-shaped main body comprising an intake section, a blower section and an outlet section;

b. a variable speed blower mounted in said main body which communicates with the intake section and the outlet section;

c. a first means for filtering mounted across the intake section and comprising one side of said main body;

d. a second means for filtering mounted upstream of said blower inlet;

e. a cylindrical outlet duct communicatingly mounted to said main body;

f. a series of outlet ports of at least two different diameters defined in said outlet duct, each part of circular configuration and placed in a spaced relationship to each other along the length of the duct;

g. a rotational mount attached to said main body comprising a circular collar of a diameter accommodatingly larger than the duct diameter to allow rotation of the duct within the collar and wherein said collar is calibrated to allow recordation of the duct portion with relation to the main body;

h. a smoke detector and smoke alarm mounted downstream of said filtering means and upsteam of said blower and means for activating said blower upon detection of a given level of smoke;

i. means for supplying power to the blower;

j. means for adjusting blower speed;

k. means for mounting the entire apparatus on a wall at ceiling height whereby air from the area to be treated is pulled through said first filter means and subsequently through said second filter means into intake section by the blower operation and forced through the outlet section to said outlet duct and along said outlet duct discharging through outlet ports so as to filter and re-circulate the air in the treated area while forming an air barrier along the length of said outlet duct.

* * * * *